US006508743B1

(12) United States Patent
Fortin

(10) Patent No.: US 6,508,743 B1
(45) Date of Patent: Jan. 21, 2003

(54) COLLAPSIBLE DOORWAY EXERCISE APPARATUS

(76) Inventor: Enrique Fortin, 6712 Magnolia Ct., South Miami, FL (US) 33143

( * ) Notice: Subject to any disclaimer, the term of this patent is extended or adjusted under 35 U.S.C. 154(b) by 0 days.

(21) Appl. No.: 09/827,748

(22) Filed: Apr. 6, 2001

(51) Int. Cl.[7] ..... A63B 3/00; A63B 1/00

(52) U.S. Cl. ..... 482/41; 482/39; 482/40; 482/38

(58) Field of Search ..... 482/38–40, 62, 482/75, 91, 96, 141, 139, 143, 904, 907, 114, 908; 606/241; 602/32, 36; 472/118, 119, 120; 108/149, 152, 108, 14

(56) References Cited

U.S. PATENT DOCUMENTS

D210,469 S 3/1968 Baekgaard et al.
3,915,452 A 10/1975 Winblad
4,458,894 A * 7/1984 Dudley ..... 272/62
4,473,225 A * 9/1984 Miller ..... 272/62
4,529,191 A 7/1985 Miller et al.
4,662,629 A * 5/1987 Plovie ..... 272/62
4,844,448 A * 7/1989 Niznik ..... 272/62
5,186,696 A * 2/1993 Pfefferle et al. ..... 482/40
5,417,628 A 5/1995 Vanderbleek
5,456,649 A * 10/1995 Horkey ..... 482/39
5,752,903 A 5/1998 Chang
5,776,033 A 7/1998 Brown
5,871,422 A * 2/1999 Elbogen ..... 482/40
6,129,650 A * 10/2000 Wedge ..... 482/139
6,179,748 B1 * 1/2001 Barr ..... 482/40

* cited by examiner

*Primary Examiner*—Michael A. Brown
*Assistant Examiner*—Lori Baker Amerson

(57) ABSTRACT

A collapsible doorway exercise device for performing pull-ups and chin-ups. The collapsible doorway exercise device includes a pull-up support assembly; and also includes a doorway mounting assembly being attached to the pull-up support assembly and including a pair of first plate members being fastened to the pull-up support assembly; and further includes a pull-up assembly including a pair of second plate members being fastened to the pull-up support assembly.

4 Claims, 3 Drawing Sheets

COLLAPSIBLE DOORWAY EXERCISE APPARATUS

BACKGROUND OF THE INVENTION

1. Field of the Invention

The present invention relates to a doorway pull-up exercise device and more particularly pertains to a new collapsible doorway exercise device for performing pull-ups and chin-ups.

2. Description of the Prior Art

The use of a doorway pull-up exercise device is known in the prior art. More specifically, a doorway pull-up exercise device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,417,628; U.S. Pat. No. 3,915,452; U.S. Pat. No. 4,529,191; U.S. Pat. No. 5,776,033; U.S. Pat. No. Des. 210,469; and U.S. Pat. No. 5,752,903.

While these devices fulfill their respective, particular objectives and requirements, the aforementioned patents do not disclose a new collapsible doorway exercise device. The inventive device includes a pull-up support assembly; and also includes a doorway mounting assembly being attached to the pull-up support assembly and including a pair of first plate members being fastened to the pull-up support assembly; and further includes a pull-up assembly including a pair of second plate members being fastened to the pull-up support assembly.

In these respects, the collapsible doorway exercise device according to the present invention substantially departs from the conventional concepts and designs of the prior art, and in so doing provides an apparatus primarily developed for the purpose of performing pull-ups and chin-ups.

SUMMARY OF THE INVENTION

In view of the foregoing disadvantages inherent in the known types of doorway pull-up exercise device now present in the prior art, the present invention provides a new collapsible doorway exercise device construction wherein the same can be utilized for performing pull-ups and chin-ups.

The general purpose of the present invention, which will be described subsequently in greater detail, is to provide a new collapsible doorway exercise device which has many of the advantages of the doorway pull-up exercise device mentioned heretofore and many novel features that result in a new collapsible doorway exercise device which is not anticipated, rendered obvious, suggested, or even implied by any of the prior art doorway pull-up exercise device, either alone or in any combination thereof.

To attain this, the present invention generally comprises a pull-up support assembly; and also includes a doorway mounting assembly being attached to the pull-up support assembly and including a pair of first plate members being fastened to the pull-up support assembly; and further includes a pull-up assembly including a pair of second plate members being fastened to the pull-up support assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible doorway exercise device which has many of the advantages of the doorway pull-up exercise device mentioned heretofore and many novel features that result in a new collapsible doorway exercise device which is not anticipated, rendered obvious, suggested, or even implied by any of the prior art doorway pull-up exercise device, either alone or in any combination thereof.

It is another object of the present invention to provide a new collapsible doorway exercise device which may be easily and efficiently manufactured and marketed.

It is a further object of the present invention to provide a new collapsible doorway exercise device which is of a durable and reliable construction.

An even further object of the present invention is to provide a new collapsible doorway exercise device which is susceptible of a low cost of manufacture with regard to both materials and labor, and which accordingly is then susceptible of low prices of sale to the consuming public, thereby making such collapsible doorway exercise device economically available to the buying public.

Still yet another object of the present invention is to provide a new collapsible doorway exercise device which provides in the apparatuses and methods of the prior art some of the advantages thereof, while simultaneously overcoming some of the disadvantages normally associated therewith.

Still another object of the present invention is to provide a new collapsible doorway exercise device for performing pull-ups and chin-ups.

Yet another object of the present invention is to provide a new collapsible doorway exercise device which includes a pull-up support assembly; and also includes a doorway mounting assembly being attached to the pull-up support assembly and including a pair of first plate members being fastened to the pull-up support assembly; and further includes a pull-up assembly including a pair of second plate members being fastened to the pull-up support assembly.

Still yet another object of the present invention is to provide a new collapsible doorway exercise device that is easy and convenient to install and use.

Even still another object of the present invention is to provide a new collapsible doorway exercise device that can easily and quickly be removed and stored in a collapsible position These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
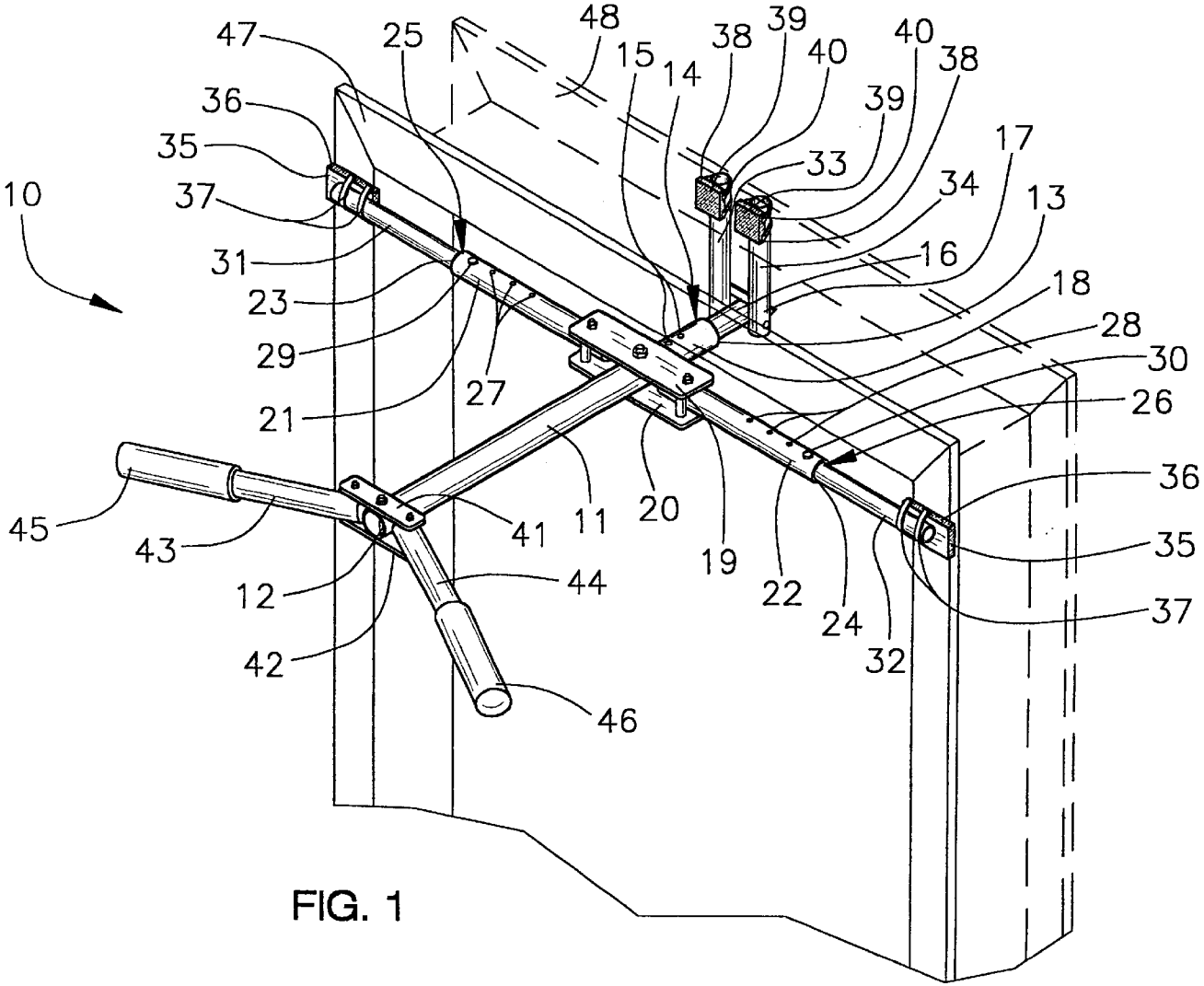
FIG. 1 is a perspective view of a new collapsible doorway exercise device according to the present invention.
Figure 2:
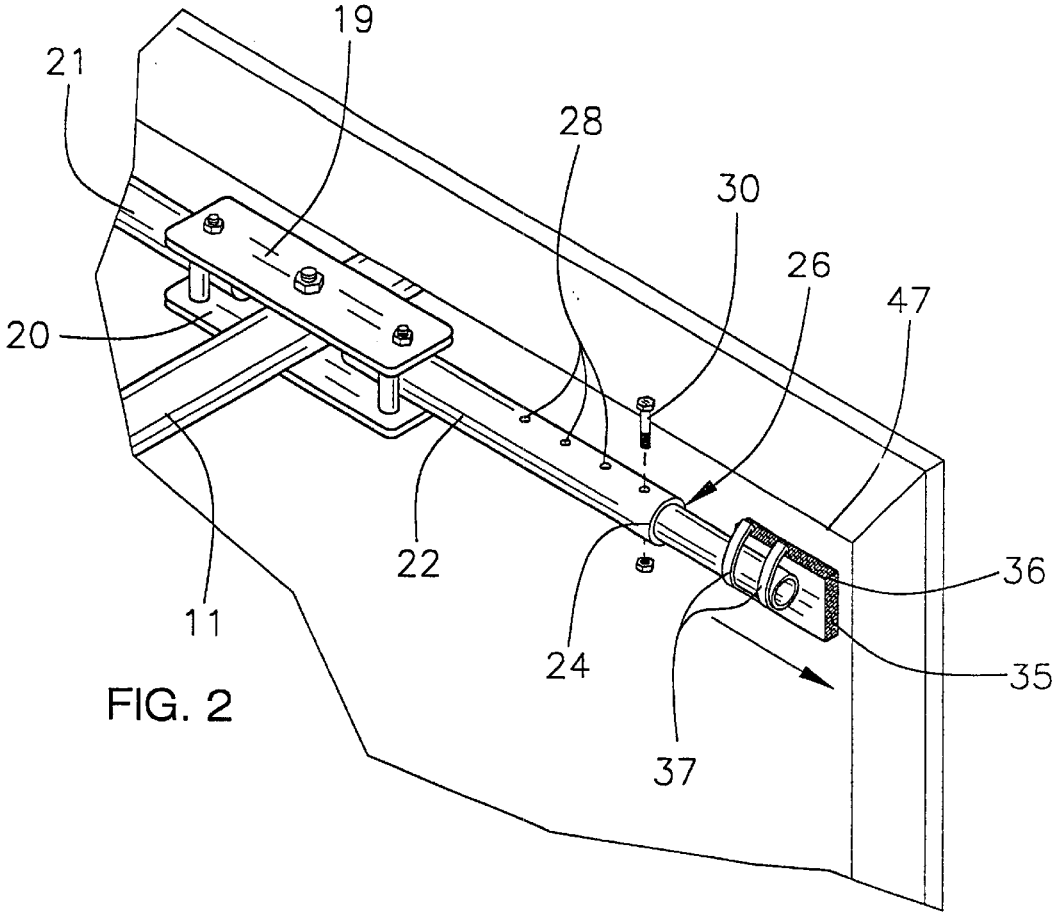
FIG. 2 is a detailed partial perspective view of the present invention.
Figure 3:
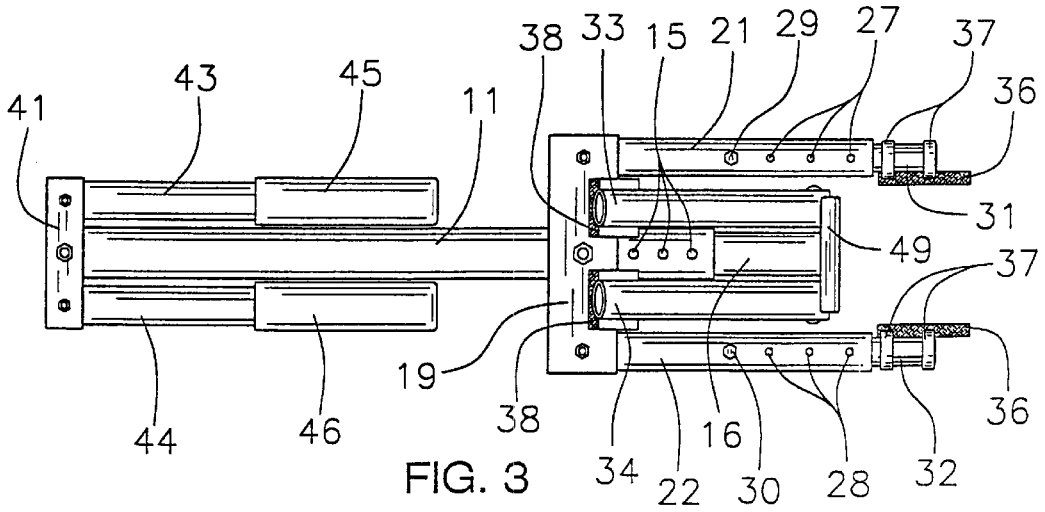
FIG. 3 is a top plan view of the present invention being collapsed.
Figure 4:
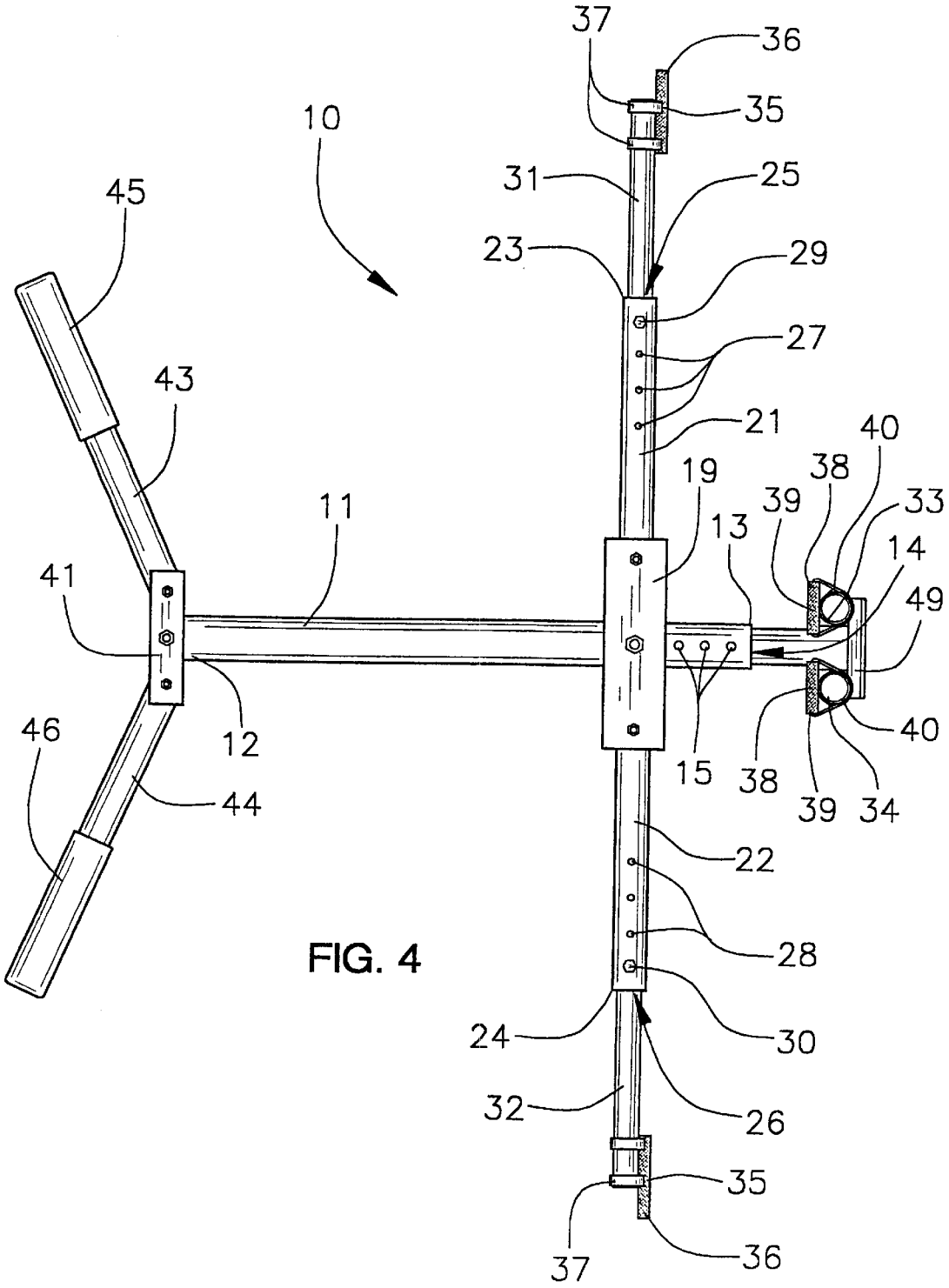
FIG. 4 is a top plan view of the present invention.

With reference now to the drawings, and in particular to FIGS. 1 through 4 thereof, a new collapsible doorway exercise device embodying the principles and concepts of the present invention and generally designated by the reference numeral 10 will be described.

As best illustrated in FIGS. 1 through 4, the collapsible doorway exercise device 10 generally comprises a pull-up support assembly which includes a tubular support member 11 having a front end 12, an open back end 13, a bore 14 extending therein through the open back end 13 and a plurality of holes 15 being spaced apart and being disposed through a side wall of the tubular support member 11, and also includes a support arm 16 being telescopingly received in and extended from the bore 14 of the tubular support member 11, and further includes a fastening member 18 being removably received in the holes 15 of the tubular support member 11 for fastening the support arm 16 to the tubular support member 11.

A doorway mounting assembly is conventionally attached to the pull-up support assembly and includes a pair of first plate members 19,20 being fastened with fasteners to the pull-up support assembly. The first plate members 19,20 are spaced apart with one of the first plate members 19 being fastened upon a top of the tubular support member 11 and with the other of the first plate members 20 being fastened to a bottom of the tubular support member 11. The first plate members 19,20 are disposed perpendicular to the tubular support member 11 and extend outwardly to either side of the tubular support member 11. The doorway mounting assembly also includes a pair of elongate tubular members 21,22 having ends securely disposed and engaged between the first plate members 19,20. Each of the elongate tubular members 21,22 has an open end 23,24, a bore 25,26 disposed therein through the open end 23,24, and a plurality of holes 27,28 being spaced apart and being disposed through a side wall thereof. The elongate tubular members 21,22 extend outwardly from either side of the tubular support member 11 and are collapsible upon the tubular support member 11. The doorway mounting assembly further includes a pair of first arm members 31,32 being telescopingly received in and extended from the bores 25,26 of the elongate tubular members 21,22, and also includes fasteners 29,30 being removably received in the holes 27,28 of the elongate tubular members 21,22 to securely fasten the first arm members 31,32 to the elongate tubular members 21,22, and further includes first cushion members 35 being removably mounted at ends of the first arm members 31,32 for engaging a wall structure about a front side of a doorway 47, and also includes second arm members 33,34 being hingedly attached at a back end 17 of the support arm 16, and further includes second cushion members 38 being mounted at ends of the second arm members 33,34 for engaging a wall structure about a back side of the doorway 48, and also includes an elongate stop member 49 being conventionally attached to the second arm members 33,34 and being engagable to the support arm 16 to prevent the second arm members 33,34 from pivoting rearwardly relative to the support arm 16. The first and second cushion members 35,38 include pad members 36,39 and eyelets 37,40 being securely and conventionally attached to the pad members 36,39 and being mounted about the first and second arm members 31–34.

A pull-up assembly includes a pair of second plate members 41,42 being fastened with fasteners to the pull-up support assembly. The second plate members 41,42 are spaced apart with one of the second plate members 41 being attached upon a top of the tubular support member 11 and with the other of the second plate members 42 being attached to a bottom of the tubular support member 11. The second plate members 41,42 are disposed perpendicular to the tubular support member 11 and extend outwardly to either side of the tubular support member 11. The pull-up assembly further includes a pair of pull-up bars 43,44 having first ends which are hingedly disposed and engaged between the second plate members 41,42, and also includes grip members 45,46 being conventionally mounted about second ends of the pull-up bars 43,44 with the pull-up bars 43,44 being collapsible upon the tubular support member 11.

In use, the user engages the second arm members 33,34 with the second cushion members 38 to the back side of the doorway 48, and engages the first arm members 31,32 with the first cushion members 35 to the front side of the doorway 47, and extends the pull-up bars 43,44 so that the user can grasp the grip members 45,46 and pull oneself upwardly upon the pull-up bars 43,44 to do pull-ups and chin-ups.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible doorway exercise device comprising:

a pull-up support assembly;

a doorway mounting assembly being attached to said pull-up support assembly and including a pair of first plate members being fastened to said pull-up support assembly;

a pull-up assembly including a pair of second plate members being fastened to said pull-up support assembly;

wherein said pull-up support assembly includes a tubular support member having a front end, an open back end, a bore extending therein through said open back end and a plurality of holes being spaced apart and being disposed through a side wall of said tubular support member, and also includes a support arm being telescopingly received in and extended from said bore of said tubular support member, and further includes a fastening member being removably received in said holes of said tubular support member for fastening said support arm to said tubular support member;

wherein said first plate members are spaced apart with one of said first plate members being attached upon a top of said tubular support member and with the other of said first plate members being attached to a bottom of said tubular support member, said first plate members being disposed perpendicular to said tubular support member and extending outwardly to either side of said tubular support member;

wherein said doorway mounting assembly also includes a pair of elongate tubular members having ends securely disposed between said first plate members, each of said elongate tubular members having an open end, a bore disposed therein through said open end, and a plurality of holes being spaced apart and being disposed through a side wall thereof, said elongate tubular members extending outwardly from either side of said tubular support member and being collapsible upon said tubular support member; and wherein said doorway mounting assembly further includes a pair of first arm members being telescopingly received in and extended from said bores of said elongate tubular members, and also includes fasteners being removably received in said holes of said elongate tubular members to securely fasten said first arm members to said elongate tubular members, and further includes first cushion members being removably mounted at ends of said first arm members for engaging a wall structure about a front side of a doorway, and also includes second arm members being hingedly attached at a back end of said support arm, and further includes second cushion members being mounted at ends of said second arm member for engaging a wall structure about a back side of the doorway, and also includes an elongate stop member being attached to said second arm members and being engagable to said support arm to prevent said second arm members from pivoting rearwardly relative to said support arm.

2. A collapsible doorway exercise device as described in claim 1, wherein said first and second cushion members include pad members and eyelets being securely attached to said pad members and being mounted about said first and second arm members.

3. A collapsible doorway exercise device comprising:

a pull-up support assembly;

a doorway mounting assembly being attached to said pull-up support assembly and including a pair of first plate members being fastened to said pull-up support assembly;

a pull-up assembly including a pair of second plate members being fastened to said pull-up support assembly;

wherein said pull-up support assembly includes a tubular support member having a front end, an open back end, a bore extending therein through said open back end and a plurality of holes being spaced apart and being disposed through a side wall of said tubular support member, and also includes a support arm being telescopingly received in and extended from said bore of said tubular support member, and further includes a fastening member being removably received in said holes of said tubular support member for fastening said support arm to said tubular support member;

wherein said second plate members are spaced apart with one of said second plate members being attached upon a top of said tubular support member and with the other of said second plate members being attached to a bottom of said tubular support member, said second plate members being disposed perpendicular to said tubular support member and extending outwardly to either side of said tubular support member; and wherein said pull-up assembly further includes a pair of pull-up bars having first ends which are hingedly disposed between said second plate members, and also includes grip members being mounted about second ends of said pull-up bars, said pull-up bars being collapsible upon said tubular support member.

4. A collapsible doorway exercise device comprising:

a pull-up support assembly, said pull-up support assembly including a tubular support member having a front end, an open back end, a bore extending therein through said open back end and a plurality of holes being spaced apart and being disposed through a side wall of said tubular support member, and also including a support arm being telescopingly received in and extended from said bore of said tubular support member, and further including a fastening member being removably received in said holes of said tubular support member for fastening said support arm to said tubular support member;

a doorway mounting assembly being attached to said pull-up support assembly and including a pair of first plate members being fastened to said pull-up support assembly, said first plate members being spaced apart with one of said first. plate members being attached upon a top of said tubular support member and with the other of said first plate members being attached to a bottom of said tubular support member, said first plate members being disposed perpendicular to said tubular support member and extending outwardly to either side of said tubular support member, said doorway mounting assembly also including a pair of elongate tubular members having ends securely disposed between said first plate members, each of said elongate tubular members having an open end, a bore disposed therein through said open end, and a plurality of holes being spaced apart and being disposed through a side wall thereof, said elongate tubular members extending outwardly from either side of said tubular support member and being collapsible upon said tubular support member, said doorway mounting assembly further including a pair of first arm members being telescopingly received in and extended from said bores of said elongate tubular members, and also including fasteners being removably received in said holes of said elongate tubular members to securely fasten said first arm members to said elongate tubular members, and further including first cushion members being removably mounted at ends of said first arm members for engaging a wall structure about a front side of a doorway, and also including second arm members being hingedly attached at a back end of said support arm, and further including second cushion members being mounted at ends of said second arm member for engaging a wall structure about a back side of the doorway, and also including an elongate stop member being attached to said second arm members and being engagable to said support arm to prevent said second arm members from pivoting rearwardly relative to said support arm, said first and second cushion members including pad members and eyelets being securely attached to said pad members and being mounted about said first and second arm members; and a pull-up assembly including a pair of second plate members being fastened to said pull-up support assembly, said second plate members being spaced apart with one of said second plate members being attached upon a top of said tubular support member and with the other of said second plate members being attached to a bottom of said tubular support member, said second plate members being disposed perpendicular to said tubular support member and extending outwardly to either side of said tubular support member, said pull-up assembly further including a pair of pull-up bars having first ends which are hingedly disposed between said second plate members, and also including grip members being mounted about second ends of said pull-up bars, said pull-up bars being collapsible upon said tubular support member.

* * * * *